US006012187A

United States Patent [19]

Bushong et al.

[11] Patent Number: 6,012,187

[45] Date of Patent: Jan. 11, 2000

[54] SUPPORT CUSHION

[76] Inventors: Mary Bushong, 38028 Lakeshore, Harrison Twp., Mich. 48045; Kathleen Leverenz, 1590 Horizon Ct, Saint Clair, Mich. 48079

[21] Appl. No.: 09/156,124

[22] Filed: Sep. 17, 1998

[51] Int. Cl.[7] ..... A47C 16/00

[52] U.S. Cl. ..... 5/648; 5/612; 5/624; 5/655.9; 5/81.1 T

[58] Field of Search ..... 5/648, 612, 621, 5/624, 655.9, 636, 638, 650, 632, 630, 88.1, 81.1 T, 653

[56] References Cited

U.S. PATENT DOCUMENTS

| | | | |
|---|---|---|---|
| 924,075 | 6/1909 | Johnson | 5/621 X |
| 2,709,435 | 5/1955 | Kress | 5/648 X |
| 2,722,692 | 11/1955 | Dempster | 5/648 X |
| 3,884,225 | 5/1975 | Witter | 5/630 X |
| 4,192,546 | 3/1980 | Smith | 297/466 |
| 4,433,678 | 2/1984 | Spann | 602/24 |
| 4,755,411 | 7/1988 | Wing et al. | 5/655.9 X |
| 4,899,405 | 2/1990 | Rothbard | 5/636 |
| 5,056,533 | 10/1991 | Solano | 5/653 X |
| 5,113,875 | 5/1992 | Bennett | 5/648 |
| 5,289,828 | 3/1994 | Toth | 5/648 X |
| 5,476,105 | 12/1995 | Toth | 5/648 |
| 5,497,520 | 3/1996 | Kunz et al. | 5/648 |
| 5,557,815 | 9/1996 | Mintz et al. | 5/636 |
| 5,673,443 | 10/1997 | Marmor | 5/88.1 |
| 5,692,246 | 12/1997 | Benedick | 5/630 X |

FOREIGN PATENT DOCUMENTS

| | | | |
|---|---|---|---|
| 2504232 | 8/1976 | Germany | 5/630 |
| 2527 | of 1911 | United Kingdom | 5/636 |

*Primary Examiner*—Terry Lee Melius
*Assistant Examiner*—Rodrigo J. Morales

[57] ABSTRACT

A support cushion for supporting the feet of a patient above a bed mattress. The support cushion includes a cushion with a transverse cross section having a pair of generally circular end regions and a generally rectangular middle region interposed between the end regions. The end regions each form a generally end portion of the cushion having a generally cylindrical configuration. The middle region forms a middle portion of the cushion having a generally rectangular configuration. A pair of a flexible flaps outwardly extend from the cushion for draping over a upwardly extending side rail located adjacent each side of a bed mattress of the patient to suspend the bottom face of the cushion above the bed mattress.

8 Claims, 2 Drawing Sheets

SUPPORT CUSHION

BACKGROUND OF THE INVENTION

1. Field of the Invention

The present invention relates to patient support devices and more particularly pertains to a new support cushion for supporting the feet of a patient above a bed mattress.

2. Description of the Prior Art

The use of patient support devices is known in the prior art. More specifically, patient support devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,168,587; U.S. Pat. No. 4,843,665; U.S. Pat. No. Des. 371,333; U.S. Pat. No. 5,117,522; U.S. Pat. No. 3,458,878; and U.S. Pat. No. 3,284,816.

While these devices fulfill their respective, particular objectives and requirements, the aforementioned patents do not disclose a new support cushion. The inventive device includes a cushion with a transverse cross section having a pair of generally circular end regions and a generally rectangular middle region interposed between the end regions. The end regions each form a generally end portion of the cushion having a generally cylindrical configuration. The middle region forms a middle portion of the cushion having a generally rectangular configuration. A pair of a flexible flaps outwardly extend from the cushion for draping over a upwardly extending side rail located adjacent each side of a bed mattress of the patient to suspend the bottom face of the cushion above the bed mattress.

In these respects, the support cushion according to the present invention substantially departs from the conventional concepts and designs of the prior art, and in so doing provides an apparatus primarily developed for the purpose of supporting the feet of a patient above a bed mattress.

SUMMARY OF THE INVENTION

In view of the foregoing disadvantages inherent in the known types of patient support devices now present in the prior art, the present invention provides a new support cushion construction wherein the same can be utilized for supporting the feet of a patient above a bed mattress.

The general purpose of the present invention, which will be described subsequently in greater detail, is to provide a new support cushion apparatus and method which has many of the advantages of the patient support devices mentioned heretofore and many novel features that result in a new support cushion which is not anticipated, rendered obvious, suggested, or even implied by any of the prior art patient support devices, either alone or in any combination thereof.

To attain this, the present invention generally comprises a cushion with a transverse cross section having a pair of generally circular end regions and a generally rectangular middle region interposed between the end regions. The end regions each form a generally end portion of the cushion having a generally cylindrical configuration. The middle region forms a middle portion of the cushion having a generally rectangular configuration. A pair of a flexible flaps outwardly extend from the cushion for draping over a upwardly extending side rail located adjacent each side of a bed mattress of the patient to suspend the bottom face of the cushion above the bed mattress.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new support cushion apparatus and method which has many of the advantages of the patient support devices mentioned heretofore and many novel features that result in a new support cushion which is not anticipated, rendered obvious, suggested, or even implied by any of the prior art patient support devices, either alone or in any combination thereof.

It is another object of the present invention to provide a new support cushion which may be easily and efficiently manufactured and marketed.

It is a further object of the present invention to provide a new support cushion which is of a durable and reliable construction.

An even further object of the present invention is to provide a new support cushion which is susceptible of a low cost of manufacture with regard to both materials and labor, and which accordingly is then susceptible of low prices of sale to the consuming public, thereby making such support cushion economically available to the buying public.

Still yet another object of the present invention is to provide a new support cushion which provides in the apparatuses and methods of the prior art some of the advantages thereof, while simultaneously overcoming some of the disadvantages normally associated therewith.

Still another object of the present invention is to provide a new support cushion for supporting the feet of a patient above a bed mattress.

Yet another object of the present invention is to provide a new support cushion which includes a cushion with a transverse cross section having a pair of generally circular end regions and a generally rectangular middle region interposed between the end regions. The end regions each form a generally end portion of the cushion having a generally cylindrical configuration. The middle region forms a middle portion of the cushion having a generally rectangular configuration. A pair of a flexible flaps outwardly extend from the cushion for draping over a upwardly extending side rail located adjacent each side of a bed mattress of the patient to suspend the bottom face of the cushion above the bed mattress.

Still yet another object of the present invention is to provide a new support cushion that helps prevent bedsores on the heels of a patient by comfortable suspending the feet of the patient above the bed mattress.

Even still another object of the present invention is to provide a new support cushion that lets air flow around the feet of the patient on the bed mattress.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
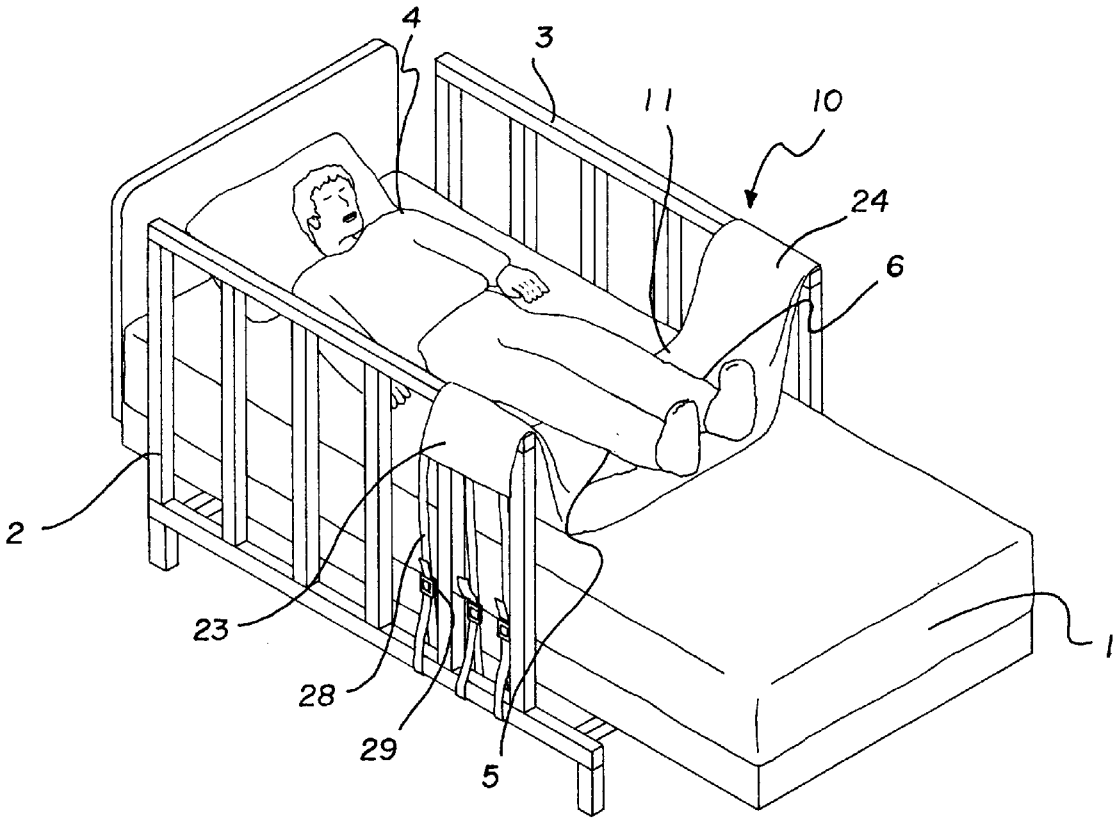
FIG. 1 is a schematic perspective view of a new support cushion in use supporting the feet of a patient above a bed mattress according to the present invention.
Figure 2:
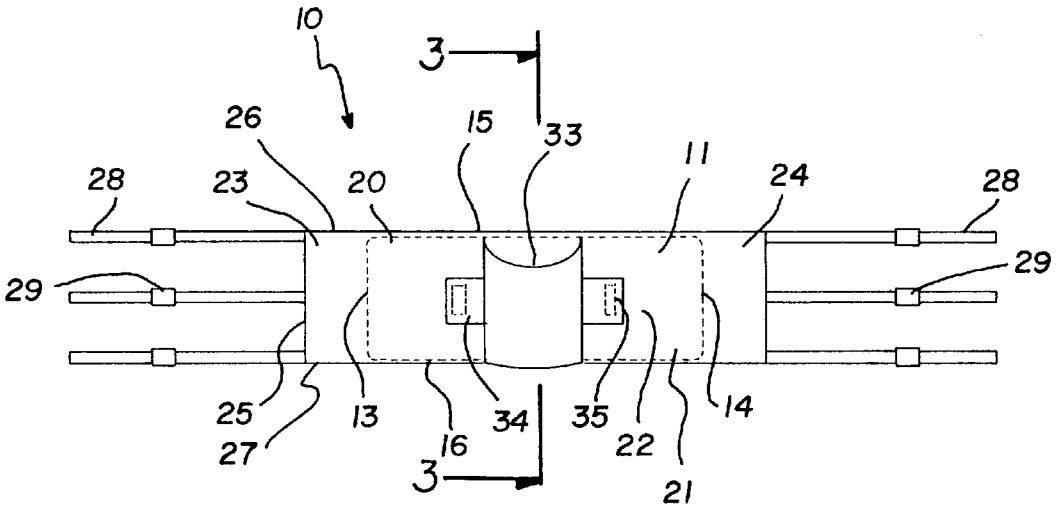
FIG. 2 is a schematic top plan view of the present invention.

With reference now to the drawings, and in particular to FIGS. 1 through 4 thereof, a new support cushion embodying the principles and concepts of the present invention will be described.

As best illustrated in FIGS. 1 through 4, the support cushion generally comprises a cushion 10 with a transverse cross section having a pair of generally circular end regions 17,18 and a generally rectangular middle region 19 interposed between the end regions 17,18. The end regions 17,18 each form a generally end portion 20,21 of the cushion 10 having a generally cylindrical configuration. The middle region 19 forms a middle portion 22 of the cushion 10 having a generally rectangular configuration. A pair of flexible flaps 23,24 outwardly extend from the cushion 10 for draping over an upwardly extending side rail 2,3 located adjacent each side of a bed mattress 1 of the patient 4 to suspend the bottom face 12 of the cushion 10 above the bed mattress 1.

The support cushion is designed for suspending the feet of a patient 4 above a bed mattress 1 to help prevent bedsore on the feet and to let air circulate around the feet. Specifically, the cushion 10 has a top and bottom faces 11,12, a pair of opposite end faces 13,14, and a pair of side faces 15,16 extending between the end faces 13,14 of the cushion 10. The cushion 10 has a longitudinal axis extending between the end faces 13,14 of the cushion 10. The cushion 10 has a length defined between the end faces 13,14 of the cushion 10, a width defined between the side faces 15,16 of the cushion 10, and a thickness defined between the top and bottom faces of the cushion 10.

Figure 3:
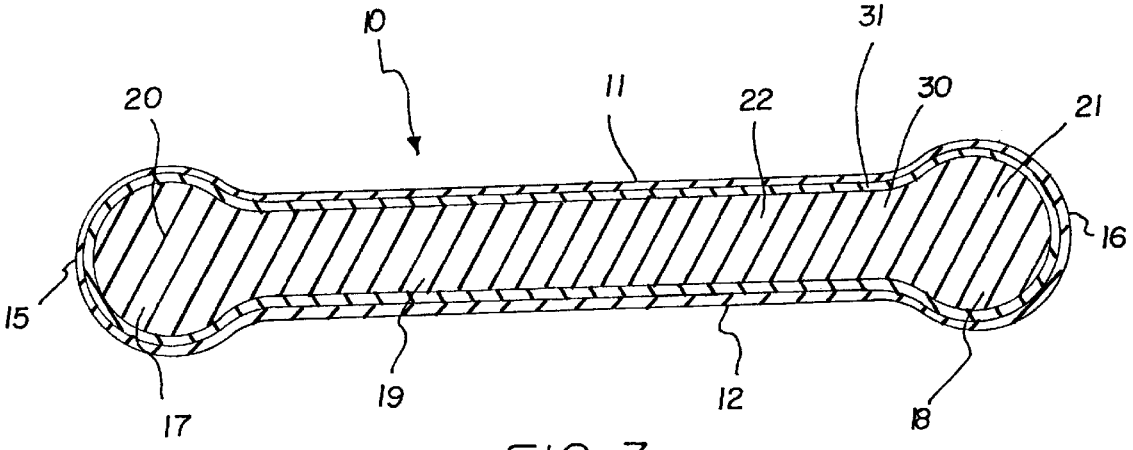
FIG. 3 is a schematic cross sectional view of the cushion taken from line 3—3 of FIG. 2.

With reference to FIG. 3, the cushion 10 has a transverse cross section taken generally perpendicular to the longitudinal axis of the cushion 10. The transverse cross section of the cushion 10 has a generally dog bone configuration including a pair of generally circular end regions 17,18 and a generally rectangular middle region 19 interposed between the end regions 17,18. One of the end regions 17 is located adjacent one of the side faces 15 of the cushion 10 and another of the end regions 18 is located adjacent another of the side faces 16 of the cushion 10. The end regions 17,18 each form a generally end portion 20,21 of the cushion 10 having a generally cylindrical configuration. The middle region 19 forms a middle portion 22 of the cushion 10 having a generally rectangular configuration. The portions of the top and bottom faces 11,12 of the cushion 10 located in the middle portion 22 are generally flat and lie in generally parallel planes. The portions of the top face 11 located in the end portions 20,21 lie in a generally common plane and the portions of the bottom face 12 located in the end portions 20,21 lie in a generally common plane generally parallel to the plane of the portions of the top face 11 located in the end portions 20,21. The planes of the portions of the top and bottom faces located in the middle portion 22 are interposed between the planes of the portions of the top and bottom faces located in the end portions 20,21 such that the thickness of the cushion 10 along the middle portion 22 is less than the thickness of the cushion 10 along each end portion 20,21.

The cushion 10 has a core 30 comprising a resiliently compressible material. Ideally, the core comprises a resiliently compressible foamed material. The cushion 10 preferably also has an outer layer substantially covering the core of the cushion 10. The outer layer ideally comprises a nylon fabric 31 coated with a water proof and air permeable urethane membrane so that the outer layer comprises a material resistant to the passage of water therethrough, the outer layer comprising a material permitting passage of air therethrough.

In use, as illustrated in FIG. 1, the cushion 10 is designed for resting the lower portion of the legs of the patient 4 thereon. A portion of the legs adjacent the knees rests on one of the end portions 20 and a portion of the legs adjacent the ankles rests on the other end portion 21 such that the feet of the patient 4 are suspended above the bed mattress 1.

Each of the end faces 13,14 of the cushion 10 has a flexible flap 23,24 outwardly extending therefrom. Each of the flaps 23,24 has a generally rectangular configuration with a free end edge 25 and pair of side edges 26,27 extending between the respective free end edge 25 and the adjacent associated end face 13,14 of the cushion 10. The end edges 25 of the flaps 23,24 extend generally parallel to the end faces 13,14 of the cushion 10. One of the side edges 26 of each of the flaps 23,24 generally lies in a common plane with one of the side faces 15 of the cushion 10. Another of the side edges 27 of each of the flaps 23,24 generally lies in a common plane with another of the side faces 16 of the cushion 10. Each of the flaps 23,24 has a length defined between the respective end edge and the adjacent associated end face 13,14 of the cushion 10. In use, each of the flaps 23,24 is designed for draping over a upwardly extending side rail located adjacent each side of a bed mattress 1 of the patient 4 to suspend the bottom face 12 of the cushion 10 above the bed mattress 1. Preferably, each of the flaps 23,24 has a plurality of elongate flexible straps 28 outwardly extending from the free end edge 25 of the respective flap 23,24. Each of the flexible straps 28 is designed for securing to the side rails 2,3 of the bed mattress 1 to help hold the cushion 10 above the bed mattress 1. Ideally, each of the flexible straps 28 has a buckle 29 designed to permit looping of the flexible straps 28 around a portion of the side rails 2,3 to secure the straps 28 to the side rails 2,3. Ideally, the plurality of flexible straps 28 of each flap 23,24 comprises three flexible straps 28 with one flexible strap positioned adjacent each of the side edges 26,27 of the adjacent associated flap 23,24, a third flexible strap positioned at a midpoint between the other two flexible straps 28.

In an preferred illustrative embodiment, the length of the cushion 10 is preferably greater than about 12 inches and the length of each of the flaps 23,24 is at least 12 inches. In an ideal illustrative embodiment, the length of the cushion is ideally about 38 inches and the length of each of the flaps 23,24 is ideally about 20 inches.

Figure 4:
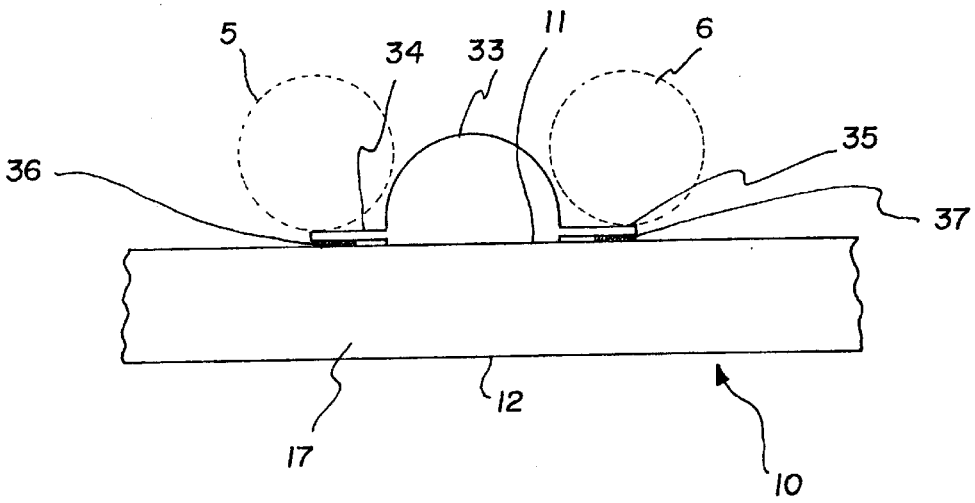
FIG. 4 is a schematic partial side view of the present invention with an optional abductor cushion coupled to the top face of the cushion to keep the patient's legs spaced apart from each other to help prevent sores on the legs of the patient from contact with each other.

With reference to FIG. 4, an optional abductor cushion 33 is coupled to the top face 11 of the cushion 10 to keep the patient's legs 5,6 spaced apart from each other to help prevent sores on the legs of the patient from contact with each other. The abductor cushion 33 has a generally D-shaped transverse cross section taken generally parallel to the longitudinal axis of the cushion 10. The abductor cushion 33 is preferably constructed with the same material as the cushion 10 so that the abductor cushion 33 has a resiliently compressible foamed material core and an water impermeable and air breathable outer layer. The abductor cushion 33 also has a pair of attachment flaps 34,35 each detachably attached to the top face 11 of the cushion 10 by hook and loop fasteners such as the type sold under the tradename VELCRO.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

we claim:

1. A support cushion for suspending a patient's feet above a bed mattress, said support cushion comprising:

a cushion having top and bottom faces, a pair of opposite end faces, and a pair of side faces extending between said end faces of said cushion, said cushion having a longitudinal axis extending between said end faces of said cushion;

said cushion having a transverse cross section taken generally perpendicular to said longitudinal axis of said cushion, said transverse cross section of said cushion having a pair of generally circular end regions and a generally rectangular middle region interposed between said end regions, one of said end regions being located adjacent one of said side faces of said cushion, another of said end regions being located adjacent another of said side faces of said cushion;

said end regions each forming a generally end portion of said cushion having a generally cylindrical configuration, said middle region forming a middle portion of said cushion having a generally rectangular configuration;

each of said end faces of said cushion having a flexible flap outwardly extending therefrom, each of said flaps being adapted for draping over an upwardly extending side rail located adjacent each side of the bed mattress of the patient to suspend said bottom face of said cushion above the bed mattress; and an abductor cushion being coupled to said top face of said cushion, said abductor cushion being adapted for keeping the patient's legs spaced apart to prevent sores on the legs of the patient from contact with each other, said abductor cushion having a generally D-shaped transverse cross section taken generally parallel to said longitudinal axis of said cushion, said abductor cushion being preferably constructed with same said material as said cushion such that said abductor cushion having a resiliently compressible foamed material core and a water impermeable and air breathable outer layer, said abductor cushion having a pair of attachment flaps, each of said attachment flaps being detachably attachable to said top face of said cushion by hook and loop fasteners.

2. The article of claim 1, wherein portions of said top and bottom faces of said cushion located in said middle portion are generally flat and lying in generally parallel planes, wherein portions of said top face located in said end portions lie in a generally common plane, wherein portions of said bottom face located in said end portions lie in a generally common plane generally parallel to the plane of said portions of said top face located in said end portions.

3. The article of claim 2, wherein said planes of said portions of said top and bottom faces located in said middle portion are interposed between said planes of said portions of said top and bottom faces located in said end portions.

4. The article of claim 1, wherein said cushion has a core comprising a resiliently compressible material.

5. The article of claim 4, wherein said cushion has an outer layer substantially covering said core of said cushion, said outer layer comprising a material resistant to the passage of water therethrough, said outer layer comprising a material permitting passage of air therethrough.

6. The article of claim 1, wherein each of said flaps having a plurality of elongate flexible straps, each of said flexible straps being adapted for securing to the side rails positioned along the sides of the bed mattress to help hold the cushion above the bed mattress.

7. The article of claim 6, wherein each of said flexible straps has a buckle adapted to permit looping of the flexible straps around a portion of the side rails to secure the straps to the side rails.

8. A support cushion for suspending a patient's feet above a bed mattress, said support cushion comprising:

a cushion having top and bottom faces, a pair of opposite end faces, and a pair of side faces extending between said end faces of said cushion, said cushion having a longitudinal axis extending between said end faces of said cushion;

said cushion having a length defined between said end faces of said cushion, a width defined between said side faces of said cushion, and a thickness defined between said top and bottom faces of said cushion;

said cushion having a transverse cross section taken generally perpendicular to said longitudinal axis of said cushion, said transverse cross section of said cushion having a pair of generally circular end regions and a generally rectangular middle region interposed between said end regions, one of said end regions being located adjacent one of said side faces of said cushion, another of said end regions being located adjacent another of said side faces of said cushion;

said end regions each forming a generally end portion of said cushion having a generally cylindrical configuration, said middle region forming a middle portion of said cushion having a generally rectangular configuration;

portions of said top and bottom faces of said cushion located in said middle portion being generally flat and lying in generally parallel planes, portions of said top face located in said end portions lying in a first generally common plane, portions of said bottom face located in said end portions lying in a second generally common plane generally parallel to the first plane of said portions of said top face located in said end portions;

said planes of said portions of said top and bottom faces located in said middle portion being interposed between said planes of said portions of said top and bottom faces located in said end portions such that a thickness of said cushion along said middle portion is less than a thickness of said cushion along each end portion;

said cushion has a core comprising a resiliently compressible material, wherein core comprises a resiliently compressible foamed material;

said cushion having an outer layer substantially covering said core of said cushion, said outer layer comprising a material resistant to passage of water therethrough, said outer layer comprising a material permitting passage of air therethrough;

each of said end faces of said cushion having a flexible flap outwardly extending therefrom, each of said flaps having a generally rectangular configuration and having a free end edge and a pair of side edges extending between the free end edge and one of said end faces of said cushion;

said end edges of said flaps extending generally parallel to said end faces of said cushion, one of said side edges of each of said flaps generally lying in a common plane with one of said side faces of said cushion, another of said side edges of each of said flaps generally lying in a common plane with another of said side faces of said cushion;

each of said flaps having a length defined between the end edge and said one of said end faces of said cushion;

each of said flaps being adapted for draping over an upwardly extending side rail located adjacent each side of a bed mattress of the patient to suspend said bottom face of said cushion above said bed mattress;

each of said flaps having a plurality of elongate flexible straps outwardly extending from said free end edge of said flaps, each of said flexible straps being adapted for securing to said side rails of said bed mattress to help hold said cushion above said bed mattress;

wherein each of said flexible straps has a buckle adapted to permit looping of said flexible straps around a portion of said side rails to secure said straps to said side rails; and an abductor cushion being coupled to said top face of said cushion, said abductor cushion being adapted for keeping the patient's legs spaced apart to prevent sores on the legs of the patient from contact with each other, said abductor cushion having a generally D-shaped transverse cross section taken generally parallel to said longitudinal axis of said cushion, said abductor cushion being preferably constructed with same said material as said cushion such that said abductor cushion having a resiliently compressible foamed material core and a water impermeable and air breathable outer layer, said abductor cushion having a pair of attachment flaps, each of said attachment flaps being detachably attachable to said top face of said cushion by hook and loop fasteners.

* * * * *